US007311565B2

(12) United States Patent
Fankhauser et al.

(10) Patent No.: US 7,311,565 B2
(45) Date of Patent: Dec. 25, 2007

(54) CABLE CONNECTING SYSTEM

(75) Inventors: Jean Fankhauser, Buschwiller (FR); Andreas Linder, Zwingen (CH)

(73) Assignee: Multi-Holding AG, Allschwil (CH)

( * ) Notice: Subject to any disclaimer, the term of this patent is extended or adjusted under 35 U.S.C. 154(b) by 11 days.

(21) Appl. No.: 10/569,238

(22) PCT Filed: Jun. 10, 2004

(86) PCT No.: PCT/CH2004/000355

§ 371 (c)(1),
(2), (4) Date: Feb. 22, 2006

(87) PCT Pub. No.: WO2005/020375

PCT Pub. Date: Mar. 3, 2005

(65) Prior Publication Data

US 2006/0292936 A1 Dec. 28, 2006

(30) Foreign Application Priority Data

Aug. 26, 2003 (DE) ..... 103 39 261

(51) Int. Cl.
*H01R 4/50* (2006.01)

(52) U.S. Cl. ..... 439/805

(58) Field of Classification Search ..... 439/428, 439/805, 910

See application file for complete search history.

(56) References Cited

U.S. PATENT DOCUMENTS

| | | | | |
|---|---|---|---|---|
| 1,039,542 A | | 9/1912 | Kennington | |
| 2,659,062 A | | 11/1953 | Tibbetts | |
| 2,777,117 A | | 1/1957 | Shrider | |
| 3,560,909 A | | 2/1971 | Wyatt et al. | |
| 5,100,348 A | * | 3/1992 | Herman et al. | 439/805 |
| 5,228,875 A | | 7/1993 | Swenson, Sr. | |
| 5,487,679 A | | 1/1996 | Quaintance | |
| 6,343,963 B1 | * | 2/2002 | Bronk | 439/805 |
| 6,695,653 B1 | * | 2/2004 | Tomasino | 439/805 |

FOREIGN PATENT DOCUMENTS

| | | |
|---|---|---|
| CH | 237 857 A | 5/1945 |
| DE | 201 19 531 U1 | 5/2002 |
| EP | 0 875 961 A1 | 11/1998 |
| FR | 846809 | 9/1939 |
| FR | 2 828 958 A1 | 2/2003 |
| GB | 953945 | 4/1964 |

* cited by examiner

*Primary Examiner*—Briggitte R. Hammond
(74) *Attorney, Agent, or Firm*—Sughrue Mion Pllc.

(57) ABSTRACT

The cable connecting system comprises a contact body (28) having first means on the cable connecting end for producing a releasable electric or mechanical connection to the end of a cable (30) and is more particularly configured as a plug contact for enabling an electrical contact on a contact side. A reliable and reusable electrical and mechanical connection is achieved in said cable connecting system in that the clamping element is configured in the form of a clamping cone (21), the clamping contour (20) has a segment (20*a*) in which the limiting surface extends approximately parallel to the surface of the cone of the clamping cone (21) and in that the inner width (w) of the clamping sleeve (23) in the area of the clamping contour (20) is smaller than the maximum outer diameter of the clamping cone (21).

18 Claims, 3 Drawing Sheets

CABLE CONNECTING SYSTEM

TECHNICAL FIELD

The present invention relates to the field of cable connections technology. It relates to a cable connection system in accordance with the precharacterizing clause of claim 1.

Such a cable connection system is known, for example, from the documents U.S. Pat. No. 3,560,909 or U.S. Pat. No. 5,487,679 or DE-U1-201 19 531.

PRIOR ART

In order to fabricate cables having a conductor cross section of a few $mm^2$ to a few 100 $mm^2$ which comprise a stranded wirestranded wire surrounded by insulation such that they are connection-ready, contact elements in the form of cable shoes, plugs, sockets or the like are usually connected to the cable ends by the exposed stranded wirestranded wire being inserted into a compression sleeve fitted on the contact element and being mechanically and electrically connected to the contact element by the sleeve being compressed. In order that the compression produces a permanent and electrically faultfree connection between the compression sleeve and the stranded wire, the compression sleeve needs to be dimensioned correctly in terms of its inner and outer diameter with respect to the stranded wire cross section. Since, owing to its function, the compression sleeve is often made from a different material than the contact element, it is connected to the contact element by means of a connection technique such as soldering, bonding or welding, usually by means of welding. Furthermore, the compression sleeve needs to be properly annealed in order to have the material properties required for the compression operation. Furthermore, a special compression swage (crimping tool, crimping insert etc.) which has the correct geometry and is correctly dimensioned is required for compressing the compression sleeve with the stranded wire.

Since the cable fabrication by means of compression sleeves is complicated and laborious owing to the above-described circumstances and it is necessary to use special tools which need to be kept available on site during fabrication, it has long been desired to simplify the fabrication process and to make this process possible without special tools. Various proposals have already been made in the past involving using axial clamping screw connections for the purpose of fabricating cables, which clamping screw connections can be actuated using normal fork wrenches.

U.S. Pat. No. 3,560,909 mentioned initially has disclosed a terminal connector for a cable, in the case of which a thread section is arranged on the rear end of a contact pin and becomes a conical point. A sleeve having a corresponding inner thread can be screwed over the end of the contact pin until the cone point hits the inner rim of a circular opening in the base of the sleeve. During fabrication, the exposed stranded wire of the cable is pushed partly through the opening into the sleeve. When the sleeve is screwed onto the end of the contact pin, the individual wires of the stranded wire are forced away outwards by the cone point and are clamped between the cone point and the inner rim of the sleeve opening (FIG. 5). One disadvantage with this type of clamping is the fact that the edge-like rim of the sleeve opening presses into the individual wires of the stranded wire so as to form a notch when the screw connection is tightened and thus reduces the mechanical strength of the individual wires.

U.S. Pat. No. 5,487,679 cited initially has disclosed a similar electrical connector, in the case of which, instead of a cone point, a point having a rounded first contour is inserted which presses against the inner wall of the sleeve with a second rounded contour. The contours are designed such that the central opening angle of the point is greater than the opening angle of the sleeve. This results in a tapering clamping region for the stranded wire of the cable to be connected. The point is made from a deformable metal such that the individual wires of the stranded wire press into the point when the connection is tightened. This solution has the disadvantage that, owing to the different contours of the point and the sleeve, only a comparatively short region is available in which the actual clamping contact takes place, and which corresponds to the region of the indents in the point. A further disadvantage is the plastic deformation of the point owing to the individual wires pressing into it: the plastic deformation leads to the reduction of clamping forces such that the clamping connection can easily lose its effectiveness. Furthermore, owing to the remaining deformations of the point, the connector can only be used once or at most a few times.

DE-U1-201 19 531, likewise cited initially, has disclosed an electrical contact part having an axial clamping screw connection, in the case of which either (FIG. 1) a contact point having a contour relating to U.S. Pat. No. 5,487,679—similar to as in U.S. Pat. No. 3,560,909—is pressed against the inner edge of a sleeve opening and thus forms a notch in the individual wires of the cable stranded wire, or (FIG. 2) a conical point can be moved through a sleeve opening having a rounded rim contour, with play. In the last mentioned embodiment, the individual wires of the stranded wire are pinched in a frictional manner between the point and the rim of the sleeve opening, which in turn leads to mechanical weakening of the individual wires.

Finally, EP-B1-0 875 961 (FIG. 1) has disclosed so-called axial screw clamps, in the case of which a clamping element, which can be screwed into a hollow-cylindrical housing, having a conical point can be screwed against a clamping contour arranged in the interior of the housing. Since in this case the clamping element is formed as a separate part without any connection to the contact side by means of techniques such as soldering, bonding or welding, there is an unfavorable current distribution primarily at high currents. Furthermore, the screw connection to be operated from the inside is complicated in terms of manipulation and prevents, for example, simple tightening of the clamping screw connection.

SUMMARY OF THE INVENTION

One object of the invention is therefore to provide a cable connection system which avoids the disadvantages of known systems and is distinguished in particular by a permanent, good electrical contact and a high mechanical strength of the connection and by simple manipulation without the need for special tools.

The object is achieved by the entirety of the features in claim 1. The essence of the invention consists in the clamping element being in the form of a clamping cone, the clamping contour comprising a section in which the limiting face extends approximately parallel to the cone face of the clamping cone, and the clear width of the clamping sleeve in the region of the clamping contour being smaller than the maximum outer diameter of the clamping cone. Owing to the particular design of the clamping zone, gentle, large-area clamping of the stranded wire is brought about which is distinguished by having a high mechanical clamping and retaining force, provides a large electrical contact area for current transmission purposes and reliably avoids notching effects on the stranded wire and associated damage. The limiting face of the clamping contour in the first section can in this case optionally extend parallel to the cone face of the clamping cone or, if it is intended that mechanical fine-wire and very fine-wire conductors be clamped particularly gently, can have a slightly (convexly) rounded section which extends on average approximately parallel to the cone face of the clamping cone.

One preferred refinement of the cable connection system according to the invention is characterized in that a thread region is arranged on that side of the clamping cone which faces away from the cable, for the purpose of screwing on the clamping sleeve, and in that a first recess is provided between the thread region and the clamping cone for the purpose of accommodating the stranded wire. This prevents, in a simple manner, the stranded wire from protruding into the thread region when the connection is mounted and impeding the screw connection of the contact body and the clamping sleeve there.

Another preferred refinement of the cable connection system according to the invention is characterized in that at least one viewing hole is provided in the clamping sleeve, it being possible to visually check the insertion of the stranded wire into the clamping zone between the clamping cone and the clamping contour through said viewing hole. This makes it possible to ensure, without any particular complexity, that the stranded wire of the cable to be connected is introduced or inserted into the clamping zone in the proper manner and thus makes possible a stable and functionally reliable screw connection. It is made particularly easy to visually check the insertion despite the different rotary position of the clamping sleeve if two opposite viewing holes are provided in the clamping sleeve.

In order that the clamping zone can be prepared in optimum fashion for the insertion of the stranded wire, it is advantageous if, in accordance with another refinement of the invention, a marker recess is arranged on that side of the clamping cone which faces away from the cable, it being necessary for the clamping sleeve to be screwed onto the contact body up to this marker recess before the stranded wire of the cable is inserted into the clamping zone between the clamping cone and the clamping contour. However, other markers can also be provided to the same effect, instead of the marker recess.

Further embodiments are described in the dependent claims.

BRIEF EXPLANATION OF THE FIGURES

The invention will be explained in more detail below with reference to exemplary embodiments in connection with the drawing, in which.

APPROACHES TO IMPLEMENTATION OF THE INVENTION

Figure 1:
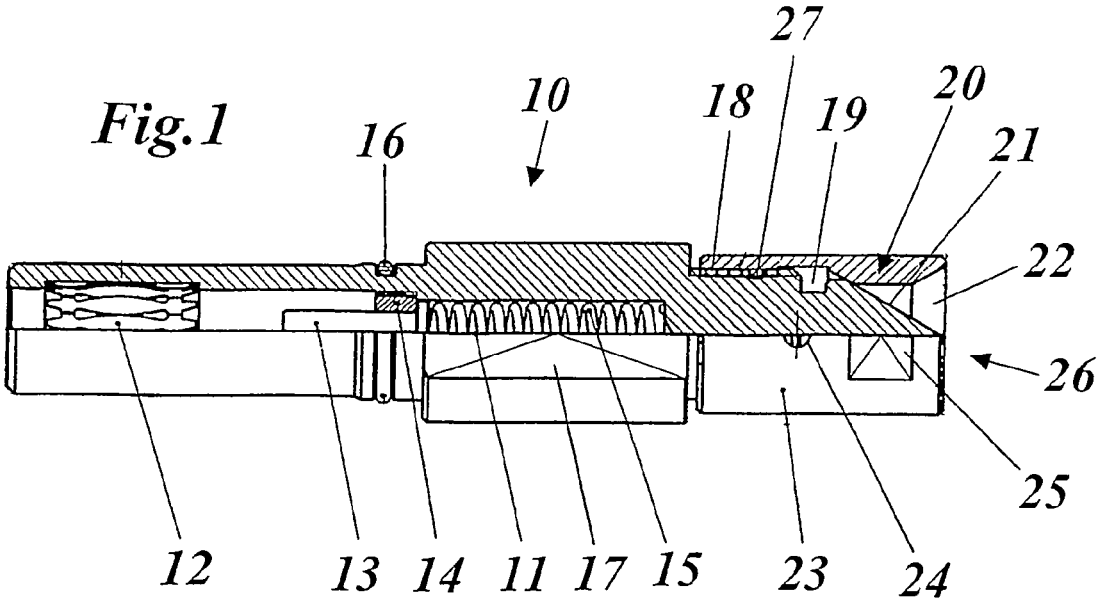
FIG. 1 shows a partially longitudinally sectioned illustration of a first exemplary embodiment of a cable connection system according to the invention which is designed for a conductor cross section of 50-70 $mm^2$ and in which the contact side is in the form of a socket.
Figure 2:
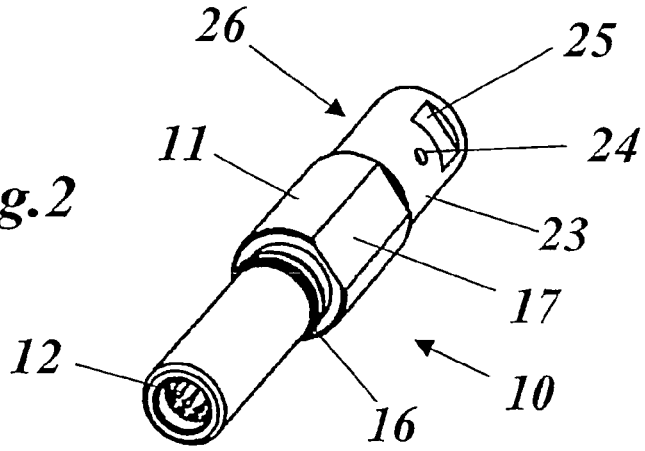
FIG. 2 shows a perspective side view of the cable connection system shown in FIG. 1.
Figure 3:
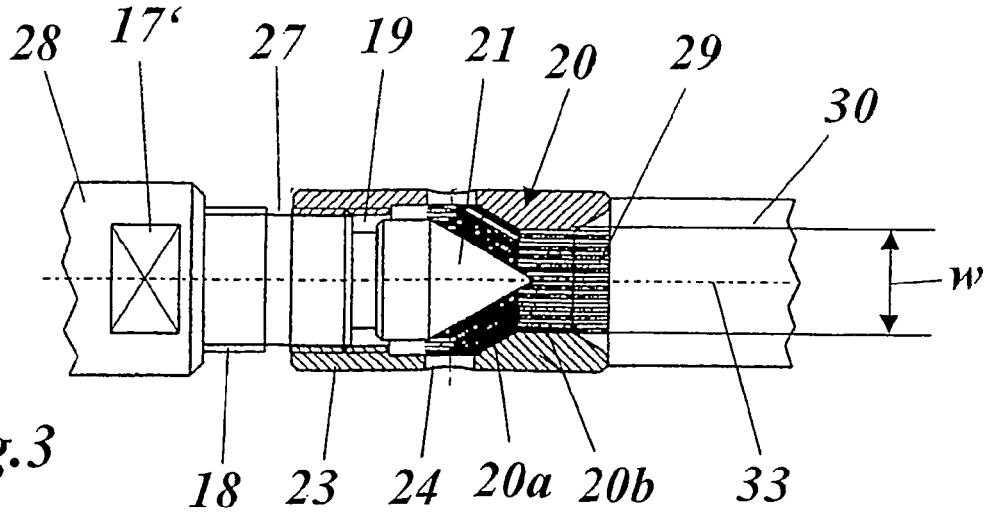
FIG. 3 shows a longitudinal section of an exemplary embodiment, comparable to that in FIG. 1, of the cable connection system according to the invention during fabrication; the clamping sleeve is screwed on up to a marker recess in order that the stranded wire of the cable to be connected can be inserted into the clamping screw connection in an optimum manner.

FIG. 1 shows a partially longitudinally sectioned illustration of a first exemplary embodiment of a cable connection system according to the invention which is designed for a conductor cross section of 50-70 $mm^2$ and in which the contact side is in the form of a socket. However, express reference should be made at this point to the fact that the solution according to the invention can be used up to the greatest conductor cross sections available on the market. FIG. 2 shows a perspective side view. The cable connection system shown in FIGS. 1 and 2 comprises a socket 10 having an essentially cylindrical socket body 11 extending along an axis 33 (FIG. 3). The socket body 11 has a hole at the left-hand end for the purpose of accommodating a plug pin (not shown), in which an annular contact lamination 12 is arranged for the purpose of making defined contact. A spring bolt 13, which can be pushed back counter to the pressure of a compression spring 15, is held at the end of the hole for the purpose of accommodating the plug pin by means of a screwed-in perforated nut 14. An O ring 16 is arranged on the outside of the socket body 11 at the level of the perforated nut 14 for the purpose of sealing the plug connection.

A thread region 18, which is provided with an outer thread and extends up to a first recess 19, adjoins the right-hand end of the socket body 11. Behind the first recess 19, the socket body 11 becomes a clamping cone 21, which runs to a point towards the end. A second recess 27, which is used as the marker recess, is provided in the center of the thread region 18. A clamping sleeve 23 can be screwed onto that end of the socket body 11 which is provided with the thread region 18 and the clamping cone 21. At one end the clamping sleeve 23 has an inner thread which fits the thread region 18. At the other end, a clamping contour 20 is integrally formed on the inside. As shown in FIG. 3, the clamping contour 20 has a first section 20*a* which tapers in the form of a cone and is adjoined by a second section 20*b* having a constant inner diameter. The opening angle of the first section 20*a* is the same as the cone angle of the clamping cone 21, with the result that the surfaces of the two elements extend parallel to one another. The clamping sleeve 23 has a funnel-shaped opening 22, through which the stranded wire 29 of a cable 30 can be inserted (FIG. 3). In each case a width across the flats 17 or 25 (17' in FIGS. 4, 5) is milled on the outside of the socket body 11 and the clamping sleeve 23 such that the clamping connection 26 comprising the clamping sleeve 23 and the clamping cone 21 can be tightened in a defined and simple manner by means of fork wrenches or with the aid of a torque wrench. Two opposite viewing holes 24 are provided in the central region of the clamping sleeve, and the insertion of the stranded wire 29 during the fabrication process can be observed and visually checked through these viewing holes 24. The socket body 11 and the clamping sleeve 23 are preferably made from brass and are provided with a silver plating. The inner diameter of the second section 20*b* of the clamping contour 20 is approximately 12 mm—if the socket 10 is designed for conductor cross sections of 50-70 $mm^2$.

FIG. 3 illustrates, in the manner of a snap shot, one step in the fabrication process which comprises several steps. For fabrication purposes, initially the stranded wire 29 is exposed at the end of the cable 30 over a predetermined length by the insulation being removed. Then, the clamping screw connection is prepared for accommodating the stranded wire 29 by the clamping sleeve 23 being screwed onto the contact body 28 up to the marker recess 27, as is illustrated in FIG. 3. If the clamping sleeve 23 is in the prescribed position, the stranded wire 29 is inserted along the axis 33 through the funnel-shaped opening 22 in the clamping sleeve 23 and pushed in to such an extent that the individual wires can easily be seen through the viewing holes 24 (FIG. 3). If the clamping sleeve is now screwed on further, the individual wires of the stranded wire located between the clamping contour 20 and the clamping cone 21 are carried along and remain visible in the viewing holes 24, if the screw connection has been performed properly. In the last stage of the screw connection, the ends of the individual wires are accommodated by the recess 19. The recess 19 makes sufficient space available for the individual wires not to penetrate into the thread region 18 and impede the screw connection operation there.

The screw connection preferably takes place by means of a torque wrench, which is placed on the width across the flats 17 or 17'. Locking takes place using a fork wrench on the width across the flats 25. The parallel orientation of the clamping faces of the clamping cone 21 and the section 20*a* of the clamping contour in conjunction with the diameter ratios (clear width w of the clamping contour 20 smaller than the maximum outer diameter of the clamping cone 21) ensures that the individual wires of the stranded wire 29 are subjected to a uniform load over a large area. As a result, a high retaining force is achieved, on the one hand, and, on the other hand, damage to the individual wires is reliably avoided. In addition, the edges of the section 20*a* can be rounded off in order to also rule out any notching effect there.

Figure 4:
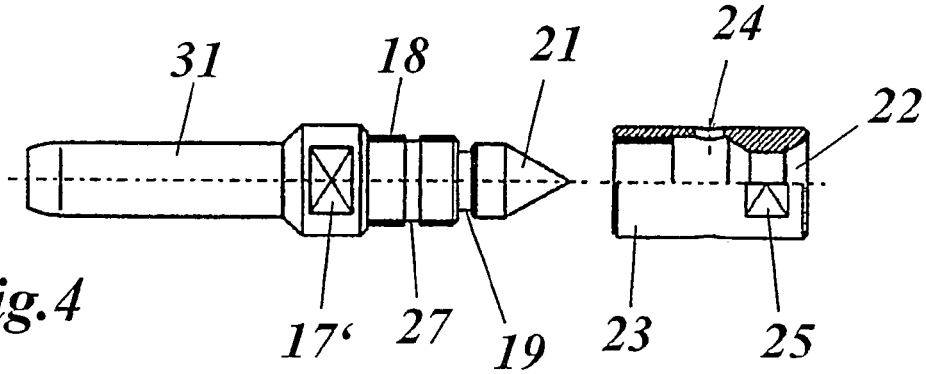
FIG. 4 shows one exemplary embodiment of the invention for line cross sections of 25-35 $mm^2$, in which the contact side is in the form of a plug.
Figure 5:
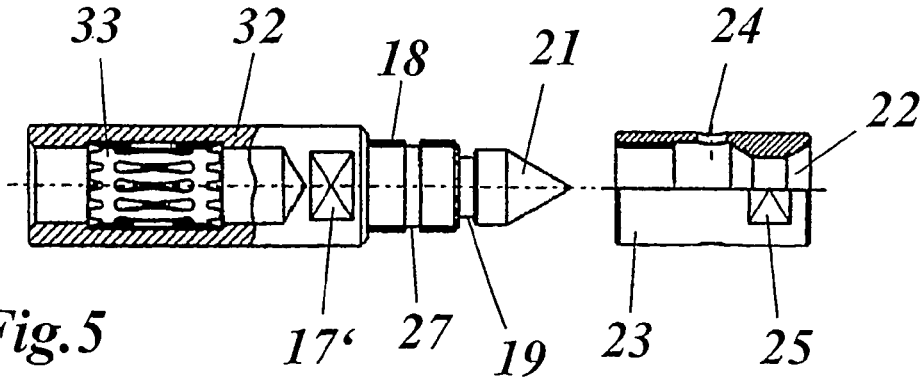
FIG. 5 shows one exemplary embodiment of the invention for line cross sections of 25-35 $mm^2$, in which the contact side is in the form of a socket.

Two exemplary clamping screw connections for smaller conductor cross sections (25-35 $mm^2$) are depicted in FIGS. 4 and 5, and these clamping screw connections are designed in the clamping region in the same way as the exemplary embodiment shown in FIG. 1. In the example in FIG. 4, the contact body is in the form of a plug 31. In the example in FIG. 5, the contact body is in the form of a socket 32 which is equipped with an annular contact lamination 33 of a known design in the interior.

Figure 6:
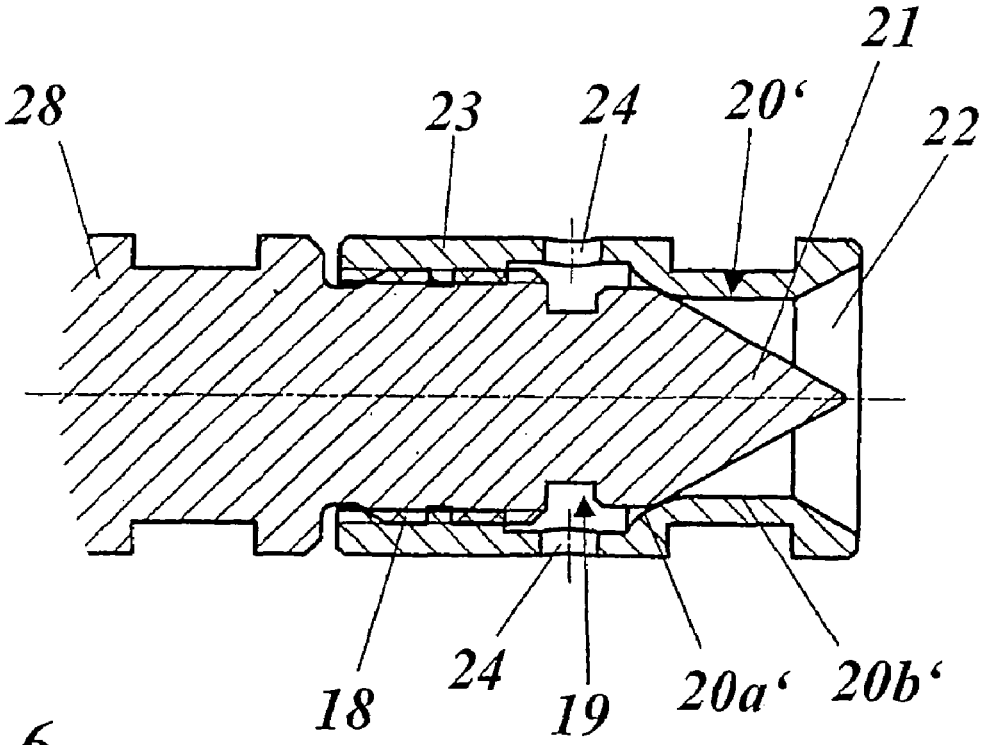
FIG. 6 shows one exemplary embodiment, comparable to that in FIG. 3, in which the clamping contour for mechanically sensitive, fine-wire or very fine-wire conductors has a rounded section opposite the clamping cone.

If, in particular, cables having mechanically sensitive, fine-wire and very fine-wire conductors are intended to be connected, it is recommended to use a cable connection system as shown in FIG. 6. In the embodiment of the invention shown in FIG. 6, a clamping contour 20' is used in the clamping sleeve 23, and this clamping contour 20' in turn comprises two sections 20*a'* and 20*b'*. The second section 20*b'* corresponds to the section 20*b* in FIG. 3. The first section 20*a'* has a contour which is slightly (convexly) rounded off and extends on average approximately parallel to the cone face of the clamping cone 21. Owing to the slightly rounded section, large-area clamping is achieved which is "gentle" with respect to an edge and is suitable in particular for sensitive individual wires of the stranded wire 29. In this regard, the edgeless transition between the first section 20*a'* and the second section 20*b'* is also particularly favorable.

Overall, the invention provides a cable connection system which is distinguished by the fact that

- no special tool is required,
- the screw connection can be released again, i.e. the clamping screw connection can be reused,
- it can be used up to the largest conductor cross sections available on the market,
- it is easy to manipulate, and
- it can be used in a time-saving and thus cost-saving manner.

LIST OF REFERENCES

10 Socket
11 Socket body
12, 33 Contact lamination
13 Spring bolt
14 Perforated nut
15 Compression spring
16 O ring
17, 17', 25 Width across the flats
18 Thread region
19 Recess
20, 20' Clamping contour
20*a*, 20*b* Section (clamping contour)
20*a'*, 20*b'* Section (clamping contour)
21 Clamping cone
22 Opening (funnel-shaped)
23 Clamping sleeve
24 viewing hole
26 Clamping screw connection
27 Marker recess
28 Contact body
29 Stranded wire
30 Cable
31 Plug
32 Socket
33 Axis
W Clear width (clamping contour)

The invention claimed is:

1. A cable connection system, comprising a contact body which has first means on a cable connecting side for the purpose of producing a releasable electrical and mechanical connection with an end of a cable to be connected and is designed on a contact side for the purpose of providing an electrical contact, in particular a plugging contact, the first means comprising an essentially rotationally symmetrical, central clamping element, which is integrally formed on the contact body and tapers along an axis towards the cable end, and a clamping sleeve which concentrically surrounds the clamping element, can be screwed to the contact body in an axial direction and has an inner, essentially rotationally symmetrical clamping contour such that, when the clamping sleeve and the clamping element are screwed together, a stranded wire, which is inserted into an intermediate space between the clamping element and the clamping contour, of the cable to be connected is clamped, characterized in that the clamping element is in the form of a clamping cone, in that the clamping contour comprises a first section in which a limiting face of the clamping contour extends approximately parallel to a cone face of the clamping cone and has a rounded edge, and in that a clear width of the clamping sleeve in the region of the clamping contour is smaller than a maximum outer diameter of the clamping cone, wherein a marker recess is arranged on a side of the clamping cone which faces away from the cable, it being necessary for the clamping sleeve to be screwed onto the contact body up to said marker recess before the stranded wire of the cable is inserted into a clamping zone between the clamping cone and the clamping contour.

2. The cable connection system as claimed in claim 1, characterized in that the limiting face of the clamping contour in the first section extends parallel to the cone face of the clamping cone.

3. The cable connection system as claimed in claim 1, wherein the limiting face of the clamping contour has a slightly rounded section in the first section such that a large-area clamping is achieved.

4. A cable connection system as claimed in claim 1, wherein a thread region is arranged on side of the clamping cone which faces away from the cable, for the purpose of screwing on the clamping sleeve, and in that a first recess is provided between the thread region and the clamping cone for the purpose of accommodating the stranded wire.

5. The cable connection system as claimed in claim 1, wherein widths across the flats are provided on the contact body and on the clamping sleeve for the purpose of tightening the screw connection with a defined torque.

6. The cable connection system as claimed in claim 1, wherein the contact body is in the form of a socket or a plug on the contact side.

7. The cable connection system as claimed in claim 1, wherein the contact body and the clamping sleeve are produced from metal.

8. The cable connection system as claimed in claim 7, wherein the contact body and the clamping sleeve are produced from brass and are provided with a silver plating on a surface.

9. A cable connection system, comprising a contact body which has first means on a cable connecting side for the purpose of producing a releasable electrical and mechanical connection with an end of a cable and is designed on a contact side for the purpose of providing an electrical contact, in particular a plugging contact, the first means comprising an essentially rotationally symmetrical, central clamping element which is integrally formed on the contact body and tapers along an axis towards the cable end, and a clamping sleeve which concentrically surrounds the clamping element can be screwed to the contact body in an axial direction and has an inner, essentially rotationally symmetrical clamping contour such that, when the clamping sleeve and the clamping element are screwed together, a stranded wire, which is inserted into the intermediate space between the clamping element and the clamping contour, of a cable to be connected is clamped, characterized in that the clamping element is in the form of a clamping cone, in that the clamping contour comprises a first section in which a limiting face of the clamping contour extends approximately parallel to a cone face of the clamping cone, and in that a clear width of the clamping sleeve in the region of the clamping contour is smaller than a maximum outer diameter of the clamping cone, wherein at least one viewing hole is provided in the clamping sleeve, it being possible to visually check an insertion of the stranded wire into a clamping zone between the clamping cone and the clamping contour through said viewing hole.

10. The cable connection system as claimed in claim 9, wherein two opposite viewing holes are provided in the clamping sleeve.

11. The cable connection system as claimed in claim 9, characterized in that the limiting face of the clamping contour in the first section extends parallel to the cone face of the clamping cone.

12. The cable connection system as claimed in claim 9, wherein the limiting face of the clamping contour has a slightly rounded section in the first section such that a large-area clamping is achieved.

13. The cable connection system as claimed in claim 9, wherein a thread region is arranged on a side of the clamping cone which faces away from the cable, for the purpose of screwing on the clamping sleeve, and in that a first recess is provided between the thread region and the clamping cone for the purpose of accommodating the stranded wire.

14. The cable connection system as claimed in claim 9, wherein a marker recess is arranged on a side of the clamping cone which faces away from the cable, it being necessary for the clamping sleeve to be screwed onto the contact body up to said marker recess before the stranded wire of the cable is inserted into the clamping zone between the clamping cone and the clamping contour.

15. The cable connection system as claimed in claim 9, wherein widths across the flats are provided on the contact body and on the clamping sleeve for the purpose of tightening the screw connection with a defined torque.

16. The cable connection system as claimed in claim 9, wherein the contact body is in the form of a socket or a plug on the contact side.

17. The cable connection system as claimed in claim 9, wherein the contact body and the clamping sleeve are produced from metal.

18. The cable connection system as claimed in claim 17, wherein the contact body and the clamping sleeve are produced from brass and are provided with a silver plating on a surface.

* * * * *